US006283399B1

(12) United States Patent
Kremer et al.

(10) Patent No.: US 6,283,399 B1
(45) Date of Patent: Sep. 4, 2001

(54) YARN TENSION DEVICE

(75) Inventors: Hubert Kremer, Grefrath; Günter Alder, Viersen; Karl-Heinz Kohlen, Mönchengladbach, all of (DE)

(73) Assignee: Sucker-Muller-Hacoba GmbH & Co., Monchengladbach (DE)

( * ) Notice: Subject to any disclaimer, the term of this patent is extended or adjusted under 35 U.S.C. 154(b) by 0 days.

(21) Appl. No.: 09/424,465

(22) PCT Filed: Apr. 14, 1999

(86) PCT No.: PCT/EP99/02523

§ 371 Date: Nov. 23, 1999

§ 102(e) Date: Nov. 23, 1999

(87) PCT Pub. No.: WO99/52806

PCT Pub. Date: Oct. 21, 1999

(30) Foreign Application Priority Data

Apr. 15, 1998 (DE) ..... 298 06 739 U

(51) Int. Cl.[7] ..... B65H 23/188

(52) U.S. Cl. ..... 242/419.4; 242/131.1; 242/149; 242/150 R

(58) Field of Search ..... 242/150 R, 131.1, 242/149, 419.4, 155 BD, 150 M

(56) References Cited

U.S. PATENT DOCUMENTS

| | | | | |
|---|---|---|---|---|
| 2,372,053 | * | 3/1945 | Bodansky | 242/150 R |
| 2,457,450 | | 12/1948 | Dewas | 242/150 |
| 2,629,561 | * | 2/1953 | Heizer | 242/150 R X |
| 2,745,610 | * | 5/1956 | Reyes | 242/150 R |
| 4,429,842 | * | 2/1984 | Kiipper | 242/149 |
| 4,809,927 | * | 3/1989 | Colli et al. | 242/150 R |
| 5,179,980 | * | 1/1993 | Hubner et al. | 242/149 X |
| 5,265,548 | * | 11/1993 | Satoma | 242/150 R X |

FOREIGN PATENT DOCUMENTS

| | | |
|---|---|---|
| 684268 | 8/1994 | (CH) . |
| 975270 | 10/1961 | (DE) . |
| 2339332 | 3/1974 | (DE) . |
| 3113829 | 1/1983 | (DE) . |
| 3505913 | 11/1985 | (DE) . |
| 273477 | 7/1988 | (EP) . |
| 683928 | 11/1952 | (GB) . |

* cited by examiner

*Primary Examiner*—Donald P. Walsh
*Assistant Examiner*—Minh-Chau Pham
(74) *Attorney, Agent, or Firm*—Pandiscio & Pandiscio

(57) ABSTRACT

A yarn braking device, in particular a double plate brake for textile yarns running from bobbin creels, with two pairs of brake plates through which the yarn passes and whose top and bottom plates are to be pressed together adjustably in order to tension the yarn passing through, with a two-armed plate lever disposed beneath the pair of brake plates and able from that location to influence pressure loads each of the pairs of plates by means of a respective one of the lever arms, and with a pressure adjusting device acting on the plate lever. So that both pairs of brake plates can be used at pressing forces as low as zero for the finest yarns and at maximal pressing forces for coarse yarns without the need to exchange the pressure adjusting device or its spring, it is proposed that the two-armed plate lever is able to lift the bottom plates of the pairs of brake plates out of an operating position in which practically no pressure is exerted on the top plates, and that the pressure adjusting device acts on the plate lever by means of a rocking lever (15) comprising attack sites, located at different distances from the plate lever, of an element generating a setting force.

10 Claims, 4 Drawing Sheets

YARN TENSION DEVICE

BACKGROUND OF THE INVENTION

1. Field of the Invention

The invention concerns a yarn braking device, in particular a double plate brake for textile yarns running from bobbin creels, with two pairs of brake plates through which said yarn passes and whose top and bottom plates are to be pressed together adjustably in order to tension the yarn passing through, with a two-armed plate lever disposed beneath the pair of brake plates and able from that location to influence pressure loads on each of said pairs by means of a respective one of the lever arms, and with a pressure adjusting device acting on the two-armed lever.

2. Description of the Prior Art

A yarn braking device having the aforesaid features is known from DEPS 975 270. The top plates are spring-loaded and the two-armed lever presses by means of a respective lever arm through a bottom plate to a top plate in order to partially compensate the spring load thereof. The magnitude of the compensating pressure depends on a yarn feeler supported on the braked yarn and responding to the yarn tension thereof, and the adjusting action of this feeler is distributed evenly between the two brakes. It is not provided to operate this yarn braking device with very low braking forces.

SUMMARY OF THE INVENTION

Contrastingly, the task of the invention is to improve a yarn braking device with the features cited a the beginning of this specification in such a way that both pairs of brake plates can be used at pressing forces as low as zero for the finest yarns and at maximal pressing forces for coarse yarns without the need to exchange the pressure adjusting device or its spring, particularly also in such a way that different braking forces are exerted at the pairs of brake plates.

It is preferred that the pressure adjusting device comprises a rocking lever that is stationary on the frame and of limited pivotability, and which with a first lever end engages the plate lever and by means of a second lever end can be acted on by a setting force. By means of the rocking lever, the forces generated by the pressure adjusting device can advantageously be introduced into the region of the plate lever. Since the rocking lever is affixed to the frame, the first lever end can transmit pressure forces merely by being laid on or against the plate lever. The rocking lever can, for example, reach underneath the plate lever to lift it in such a way that the bottom plate is urged by pressure out of an initial operating position. For example, out of the initial operating position with a pressing force of zero on the top plate. In the process, setting force must be applied to the second lever end in the same direction of rotation.

An advantageous improvement of the yarn braking device is realized in that the rocking lever acts on the plate lever to realize different lengths for the lever arms. The ability to predefine different lengths for the lever arms can be utilized above all to distribute the pressing forces generated by the pressure adjusting device differently between the pairs of brake plates. With sensitive yarns, in particular, the take-up pair of plates will be involved only slightly in the generation of yarn tension. Especially in the case of sensitive yarns, the take-up pair of plates serves primarily to prevent bunching of the yarn and/or the accumulation of twist. However, the different lengths of the lever arms can also be predefined so that they are able to offset an uneven distribution of mass of the plate lever over its length.

It is preferable that the rocking lever be displaceable in such a way as to predefine different-length lever arms of the plate lever. In this case, the rocking lever is also the element by which different-length lever arms of the plate lever can be adjusted or predefined. For this purpose, the position of the attack site of the first lever end on the plate lever can be influenced by the displacement of the rocking lever.

The aforesaid displacement can, in particular, by realized in that the rocking lever is disposed transversely to the plate lever and can be displaced in the direction of its rocker shaft on the brake frame. In such a case the rocker shaft can be realized as a displacing means, for example as an adjusting screw, by which the rocking lever is displaced transversely.

A structurally very advantageous embodiment of a yarn braking device is obtained in that said device has a base part that is fixedly connected to a strut of a brake frame and it has an exchangeable part that is detachably fastened to the base part and comprises the pair of brake plates, including the plate lever. The exchangeable part can be exchanged quickly and simply without tools, for example if there is a defect in the brake region of the yarn braking device or if brake plates with another surface are needed. This can be necessary for adaptation to different yarns, for example when multifilaments are to be processed instead of staple fibers.

BRIEF DESCRIPTION OF THE DRAWINGS

The invention is explained with reference to an exemplary embodiment depicted in the drawings. These show, in schematic representation.

DETAILED DESCRIPTION OF THE INVENTION

Figure 1:
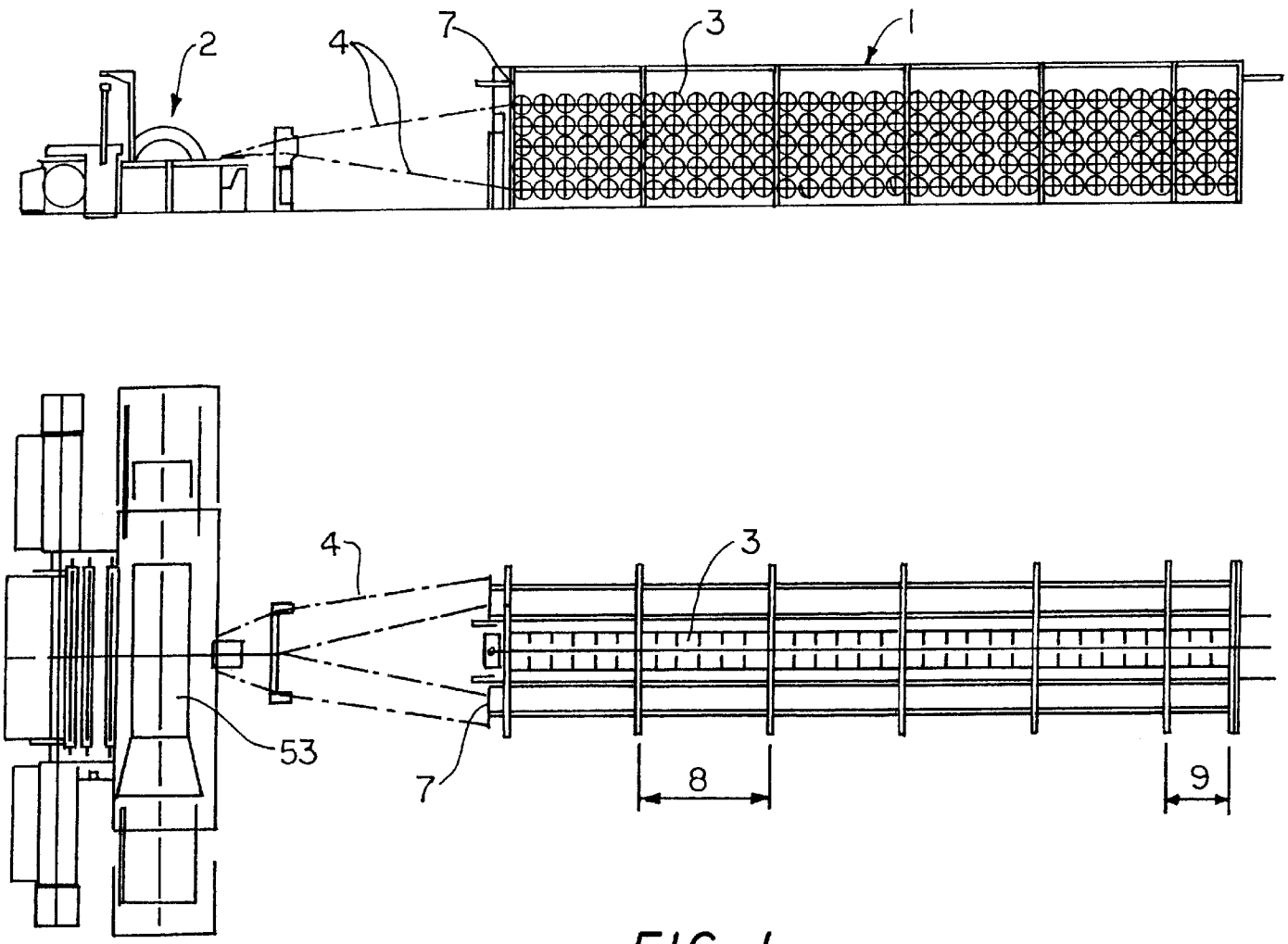
FIG. 1: a side elevation (top) and a view in plan (bottom) of a warping installation with a parallel creel.
Figure 2:
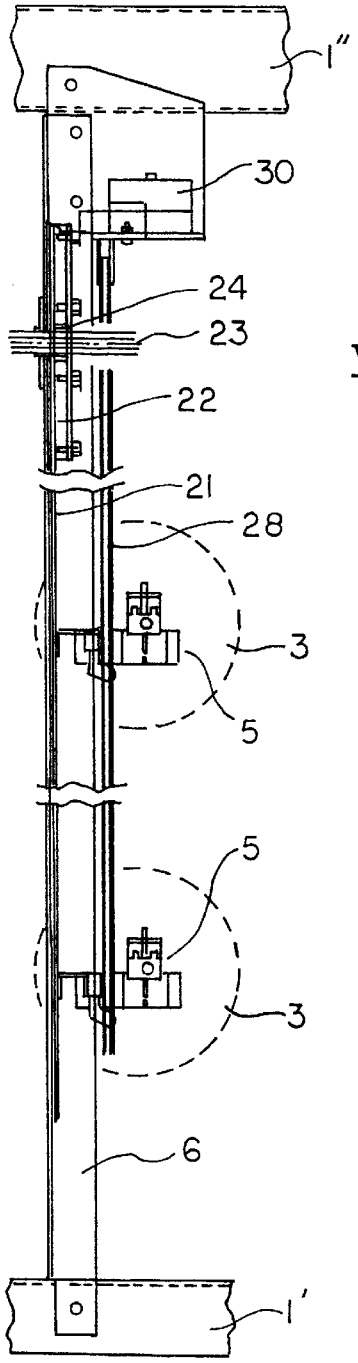
FIG. 2: a side elevation of a portion of a creel frame with a brake frame ahead of bobbins of a bobbin creel.
Figure 3:
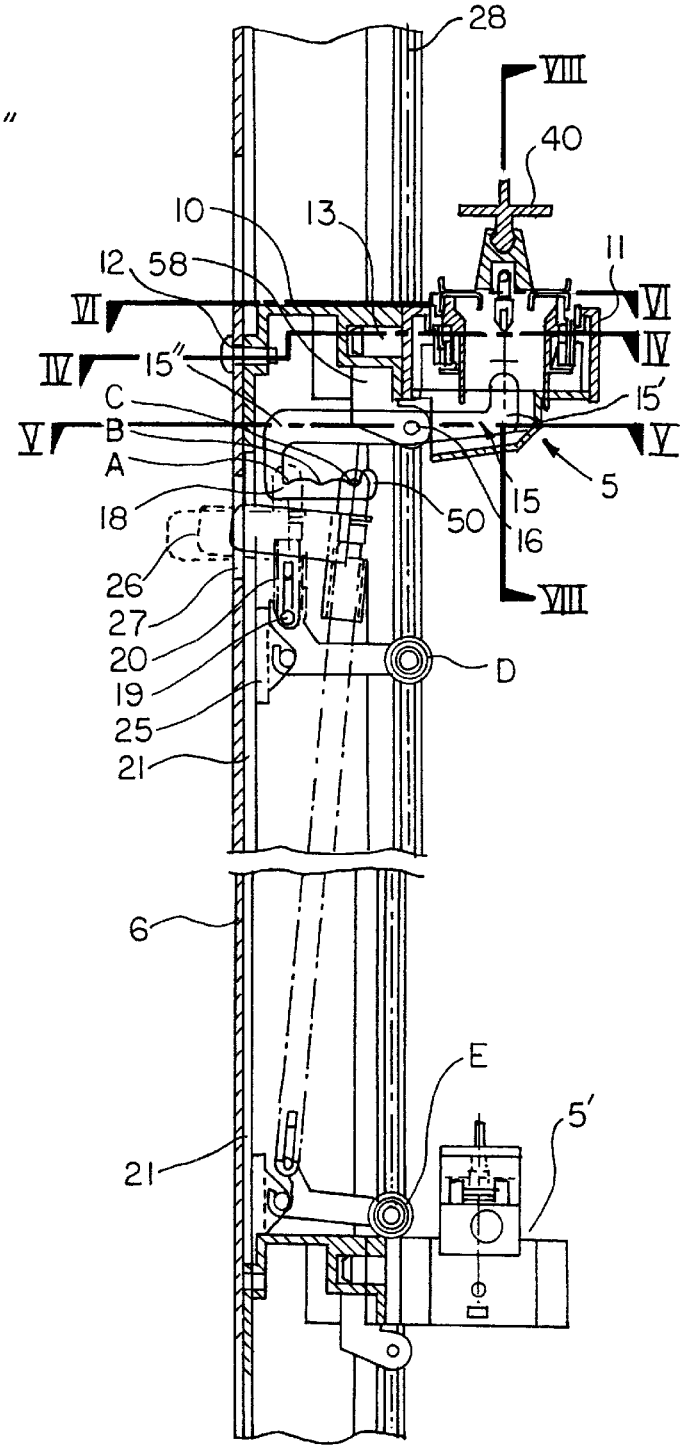
FIG. 3: a representation on an enlarged scale of FIG. 2 in the region of a yarn braking device.
Figure 4:
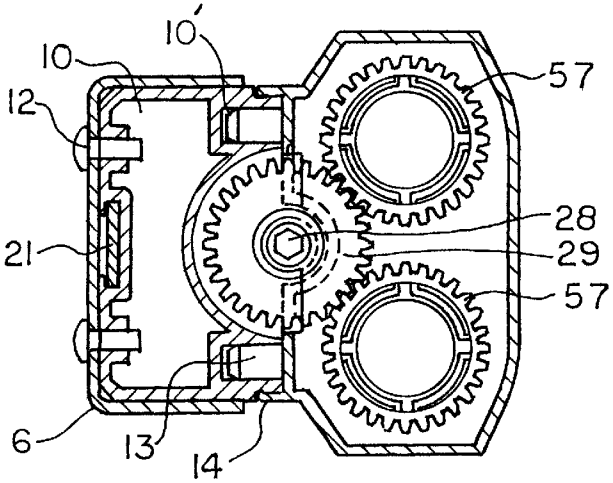
FIG. 4: a horizontal section through the yarn braking device of FIG. 3 at the level of a brake-plate drive.

The warping installation depicted in FIG. 1 essentially comprises a parallel creel 1 and a sectional warping machine 2. The sectional warping machine 2 has a warping drum 53, by means of which a warp of yarns 4, each of which is drawn from a bobbin 3, is taken up bandwise. The bobbins 3 are arranged in creel sections 8 or in half-sections 9, a section 8 consisting of two half Assigned to each bobbin location with its bobbin 3 is a yarn braking device 5, 5' realized as a double plate brake. FIG. 2 shows two bobbins 3 disposed one above the other in a vertical row of bobbins behind two yarn braking devices 5, which are disposed in a vertical strut 6 of a brake frame, which in turn is fastened to an upper strut 1" and a lower strut 1' of the creel. An essential component of a creel strut 6 is the profiled bar visible in more detail in FIG. 3, specifically a U-shaped profiled bar as shown in FIG. 4. A base part 10 of the yarn braking device 5 is mounted inside the U-shaped profiled bar and fastened by means of screws 12. Connected to the base part 10 is an exchangeable part 11. A plug connector, consisting essentially of pins 13 of exchangeable part 11, is present and is inserted into plug-connector recesses 10'. Exchangeable part 11 is latched to base part 10 by means of clips 14, but can be exchanged quickly and easily, specifically without tools, if the exchangeable part 11 is defective or must be replaced for operational reasons.

Figure 8:
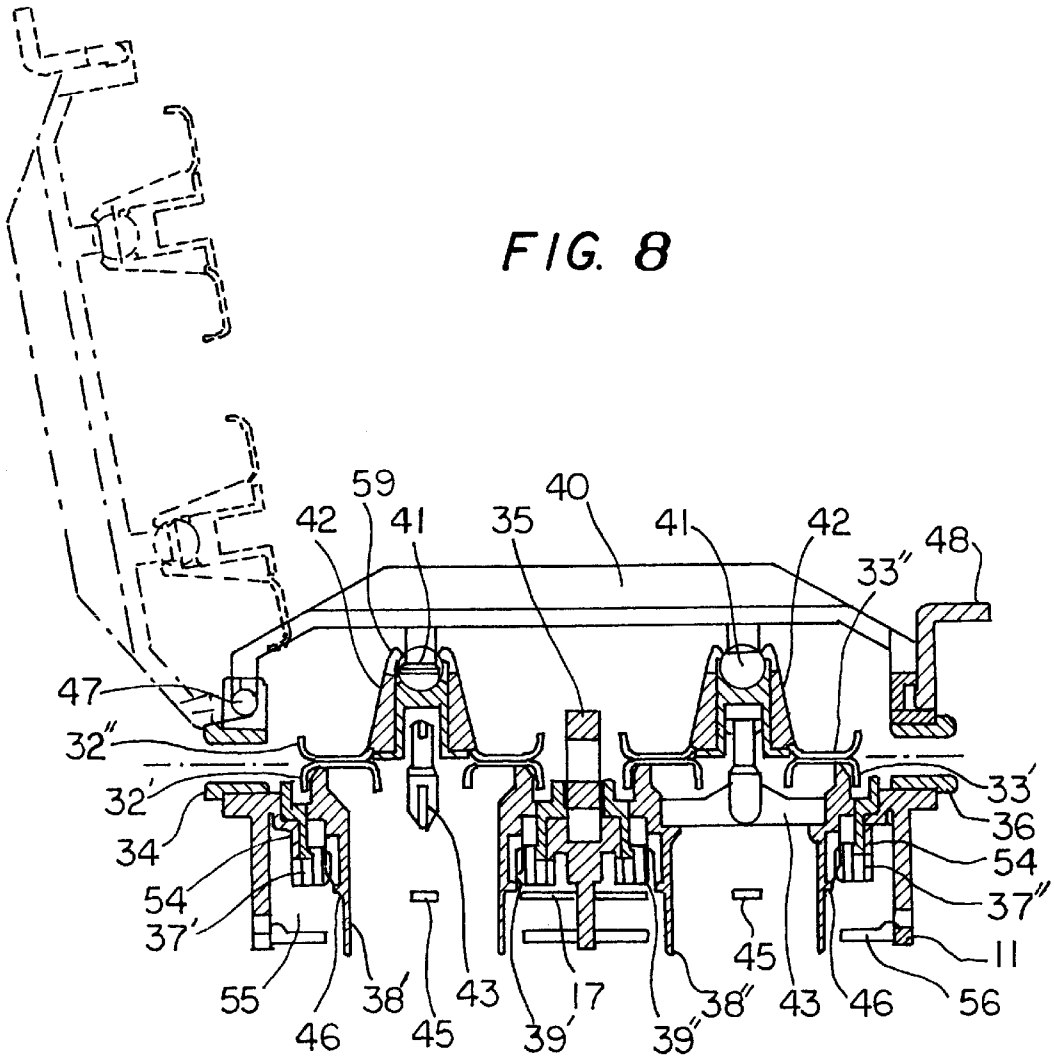
Figure 7:
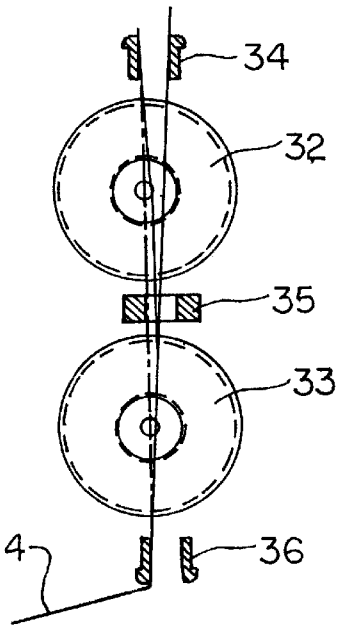
FIG. 7: a diagram to explain the path of the yarn through a yarn braking device in accordance with FIG. 3, and FIG. 8: a longitudinal section of the yarn braking device according to FIG. 3 through two pairs of brake plates in the plane of the yarn path.

The exchangeable part 11 is a component of a double plate brake with two brake plate pairs 32, 33. A yarn 4 is guided between the bottom plates 32', 33' and the associated top plates 32", 33". FIG. 7 shows that the yarn 4 is guided by eyelets. An intake eyelet 34 guides the yarn running in from a bobbin 3 between the plates 32', 32" of the intake plate pair 32. From there the yarn 4 passes through an intermediate eyelet 35 between the plates 33', 33" of the takeoff plate pair 33 to the takeoff eyelet 36, from which the yarn 4 is deflected to run parallel to the longitudinal extension of the creel 1 and on to the warping machine 2. FIG. 8 shows the eyelets 34 to 36 involved, in longitudinal section through plates 32', 32" and 33'. 33".

The top plates 32", 33" are connected to an exchangeable bridge 40 and the bottom plates 32', 33" rest loosely on bearing bushes 38', 38", which are realized so that the bottom plates 32', 33' are entrained rotationally by friction when the brushes 38', 38" are driven rotationally. The rotational driving of the bushes 38', 38" are driven rotationally. The rotational by friction when the brushes 38', 38" are driven rotationally. The rotational driving of the bushes 38', 38" also causes the top plates 32", 33" to be entrained rotationally, since the plates in each plate pair 32, 33 are rotationally form-fittingly connected by a ceramic pin 43. The ceramic pins 43 are, on the one hand, hingedly mounted on the bushes 38', 38".

The rotational driving of the bearing bushes 38', 38" is effected by means of gear bushes 37', 37", comprising, at their end adjacent the bearing bush, dogs 39', 39" that engage teeth on the bushes 38', 38" and can entrain them when the gear bushes 37', 37" carrying them are driven. The bushes 37', 37" rest, vertically supported, in mountings 54 of the exchangeable part 11 that are "let down" in a pot-like manner, each of which is disposed inside a cavity 55 closed at the bottom by a cover 56 and has at its outer circumference circumferential teeth 57, visible in more detail in FIG. 4, which are rotationally drivingly engaged by a central gear 29 with the appurtenant teeth.

The central gear 29 is connected to a vertical hexagonal drive shaft 28, which, as shown in FIG. 2, extends over all the bobbin locations and past all the yarn braking devices 5 and at its upper end is set in rotation by means of a gear motor 30 fastened to the brake frame. The hexagonal shaft 28 is rotationally mounted on bearings on the base parts 10 of the yarn braking devices disposed vertically above one another, so that the central gears 29 are assigned to their base parts 10 or to the strut 6 of the brake frame. When an exchangeable part 11 is removed from its base part 10, the central gear 29 remains in place.

Figure 6:
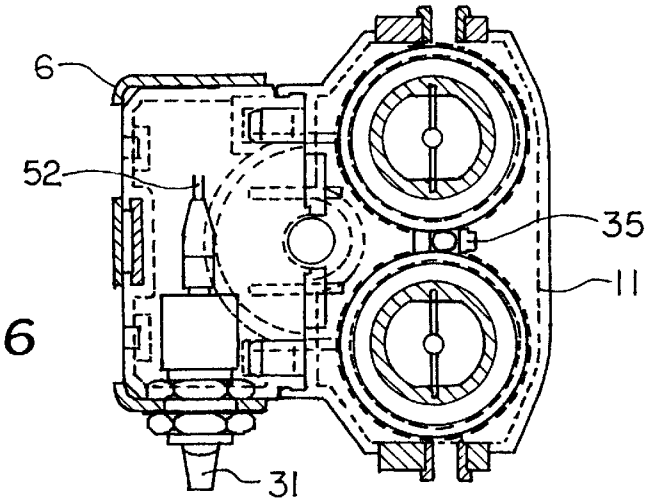
FIG. 6: a cross section through the yarn braking device of FIG. 3 to explain the ability of the plate drive to be turned off.

The gear motor 30 can be turned off. This is done by means of a toggle switch 31 visible in FIG. 6, via whose output lead 52 the power supply to the gear motor 30 can be interrupted. This makes it possible to shut off the rotational drive to the yarn braking devices 5 of a vertical row of brakes. The toggle switch can be replaced by a suitable control means. By the control means the gear motors can be switched on and off as needed.

Shown in FIG. 8 more than 90° in the direction of the bobbin. Before this can be done, a latched position must first be released by means of a handle 48 provided at the opposite end of the exchangeable part 11 from the articulation site 47. When the top plate bridge 40 is in raised position, the latching parts 42 and thus the top plates 32", 33" can be pulled off the balls 41, causing the latching arms 59 of latching parts 42 to spring back over the largest ball diameter and also overcoming a latching deformation of the balls 41 that serves to effect more secure retention and to prevent the latching parts 42 from tilting in takeoff mode.

The lengths L', L" of the rocking levers 17', 17" can be arbitrarily predefined. They can also be made of equal length. It is advantageous, however, for the lever arms L', L" to be of unequal length. Setting forces introduced by the rocking lever 15 are distributed to the pairs 32, 33 of plates in inverse proportion to the lengths L':L". This can also be used to assign lower bearing pressures to one pair of plates and higher bearing pressures to the other. Such an asymmetrical distribution of pressure forces makes it possible to divide the production of yarn tension differently between the pairs 32, 33 of plates. In particular, lower pressure forces can be assigned to the intake plate pair 32, primarily in order to prevent bunching of the yarn and the accumulation of twist that might be produced by excessive pressure forces at this location. Dividing the pressure forces between two pairs 32, 33 of plates makes it possible of the yarn to pass through the yarn braking device under lower stress, depending on the pair of plates, 32 or 33. In particular, it will be appreciated as an advantage that the bottom plates 32", 33', aided by the force of gravity, cannot slip downward. The risk of yarn breakage due to thick places in the yarn, e.g. knots, is substantially reduced.

Figure 5:
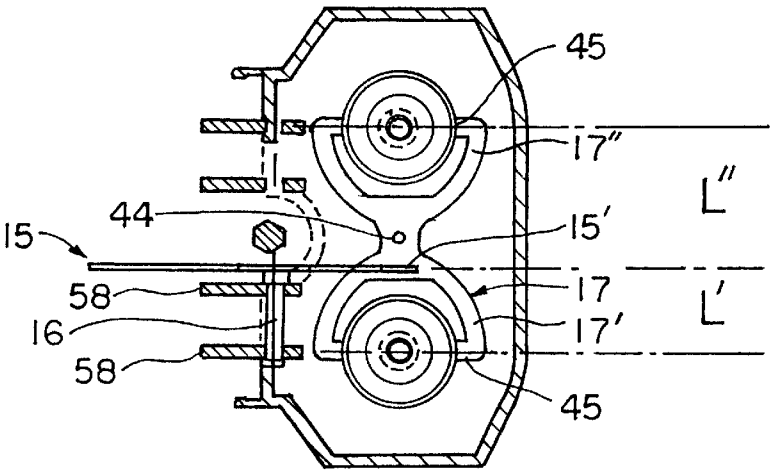
FIG. 5: a cross section through the yarn braking device of FIG. 3 in the region of a horizontal two-armed plate lever and the application thereto of a setting force by a rocking lever.

The rocking lever 15 can exert a tipping moment on the plate lever 17 at predefinable locations. Lengths L', L" can therefore be adjusted in relation to each other. This purpose is served by displaceability in the region of its rocker shaft 16, by which it is fastened to the frame. The rocking lever 15 is therefore also assigned to the base part 10 and does not have to be dismounted when the exchangeable part 11 is removed. The angle lever 15 is fastened to the base part 10 by means of angle levers 58 into which the rocker shaft 16 is screwed, for example. If the rocker shaft 16 is screwed slightly less deeply into the angle lever 58, the rocking lever 15 comes to lie higher in the plane of drawing and the ration L':L" changes accordingly. The rocker shaft 16 can also be realized as an individual adjusting device. It can, in particular, be realized so that the exchangeable part 11 need not be removed in order to displace the rocking lever 15 upwardly or downwardly in the plane of drawing of FIG. 5. All that is needed for this purpose is a lateral, free, penetration aperture (FIG. 5, bottom) with a socket wrench placed in or over an adjusting head (not shown) of the rocker shaft 16.

The rocking lever 15 has two lever ends 15', 15". By means of lever end 15' the rocking lever presses on the plate lever 17. By lever end 15", the rocking lever is connected to a draw spring The draw spring 20 has at its bottom end a formed part 19 by which it is suspended in a mounting 25. The mounting, in turn, fits snugly against a vertically movable slide bar 21.

The slide bar 21 is guided vertically on the strut 6 by the base part 10 and, like the hexagonal shaft 28, extends vertically over all the bobbin locations, as shown in FIG. 2. Fastened to the upper end of the adjusting bar 21 is a toothed rack 22. Said toothed rack 22 is engaged by a gear 24 disposed on a horizontal hexagonal shaft 23. Said hexagonal shaft 23, which thus extends transversely to the strut 6 over the entire length of the creel, can displace the slide bar 21 or all the slide bars 21 of the creel 1 vertically upwardly or downwardly when it is driven rotationally in the appropriate direction of rotation. This is to be effected by means of a displacing unit (not shown), which, for example, comprises a rotational-drive motor. One displacing unit (not shown) can be assigned to each end of the creel. However, the hexagonal shaft 23 can also be divided according to the sections 8 or half-sections 9, so that corresponding segments of hexagonal shafts can then each be displaced independently of one another. By appropriate variation it is possible to adjust the drive units The movement of the mounting 25 can take place over substantial lengths. FIG. 3 shows that the mounting 25 can be moved into the vicinity of a next-lower yarn braking device 5'. During this operation, the draw spring 20 is considerably extended and exerts correspondingly high tensile forces on lever arm 15", which in turn causes the bottom plates 32', 33' to be pressed forcefully against the top plates 32", 33". To this extent, positions D, E represent the extreme positions of the mounting 25. Position D is so far up that the rocking lever is completely relieved of its load or, as necessary, is impelled vertically upwardly to such an extent that the previously described operating position of the bottom plates 32', 33' is reached, wherein said bottom plates 32', 33' exert no bearing pressure, or in any event practically no bearing pressure, on the top plates 32", 33". As necessary, the rocking lever 15 can also be raised to relieve the plate pairs 32, 33 of their load.

What is claimed is:

1. A yarn braking device for textile yarns running from bobbin creels the braking device comprising two pairs of brake plates through which the yarn runs, the brake plates comprising top and bottom plates adapted to be pressed together adjustably to tighten the through-passing yarn, a two-armed plate lever disposed beneath the pair of brake plates and adapted to influence pressure loads on each of said pairs of plates by means of a respective one of the lever arms, and a pressure adjusting device acting on the plate lever, wherein the two-armed plate lever is adapted to lift the bottom plates of the pairs of brake plates out of an operating position wherein substantially no pressure is exerted on the top plates and wherein the pressure adjusting device acts on the plate lever by means of a rocking lever that comprises attack sites, located at different distances from the plate lever, of an element generating a setting force, and wherein the pressure adjusting device has the rocking lever that is mounted on a frame and of limited pivotability thereon, and which with a first lever end engages the plate lever and by means of a second lever end is acted upon by the setting force, and wherein the rocking lever second lever end has suspended therefrom, at a plurality of predefined locations on a free leg of the lever end, a draw spring that generates the setting force and by means of which a tipping moment is exerted on the plate lever.

2. A yarn braking device according to claim 1 wherein the draw spring is provided, near the rocking lever, with a handle by which it is adapted to be shifted between suspension sites.

3. A yarn braking device according to claim 1, wherein the draw spring is connected at an end thereof remote from the rocking lever to a mounting that is adapted to be displaced vertically, to a vicinity of a next-lower yarn braking device of a bobbin creel.

4. A yarn braking device according to claim 3 wherein the mounting is affixed to a vertically movable slide bar which is adapted to effect vertical displacements of the mounting and additional mountings of a vertical row of brakes.

5. A yarn braking device according to claim 4 wherein a plurality of slide bars of vertical rows of brakes are vertically movable, individually, in groups or as a whole, by means of a central adjusting device.

6. A yarn braking device according to claim 1 wherein the rocking lever is adapted to be displaced to predefine different-length lever arms of the plate lever.

7. A yarn braking device according to claim 1 wherein said braking device further comprises a base part fixedly connected to a strut of a brake frame, and comprises an exchangeable part removably attached to the base part and which carries the pair of brake plates including the plate lever.

8. A yarn braking device according to claim 7, wherein rotationally mounted on the base part is a drive shaft that carries a central gear and additional central gears of additional brakes, and wherein the central gear is able to drive bearing bushes vertically supporting the bottom plates.

9. A yarn braking device according to claim 8 wherein the drive shaft comprises a gear motor adapted to be turned off.

10. A yarn braking device according to claim 7, wherein all the top plates are fastened cardanically, by means of balls and latching parts snapped thereon, to a top plate bridge adapted to be lowered onto the exchangeable part and is lockably articulated therewith.

* * * * *